US008250826B1

(12) United States Patent
Vogt

(10) Patent No.: US 8,250,826 B1
(45) Date of Patent: Aug. 28, 2012

(54) HINGEABLE DERRICK

(75) Inventor: Dewayne G. Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 245 days.

(21) Appl. No.: 12/760,005

(22) Filed: Apr. 14, 2010

(51) Int. Cl.
*E04H 12/00* (2006.01)

(52) U.S. Cl. ..... 52/651.05; 52/117; 52/641

(58) Field of Classification Search ..... 52/117, 52/69, 119, 120, 641, 651.05, 651.06
See application file for complete search history.

(56) References Cited

U.S. PATENT DOCUMENTS 3,295,270 A * 1/1967 Woolslayer et al. ..... 52/117
3,367,448 A * 2/1968 Wille ..... 187/243
4,269,395 A * 5/1981 Newman et al. ..... 254/386
4,383,616 A * 5/1983 Sterner et al. ..... 212/299
4,489,526 A * 12/1984 Cummins ..... 52/125.6
4,598,509 A * 7/1986 Woolslayer et al. ..... 52/118
4,725,179 A 2/1988 Woolslayer et al.
6,345,471 B1 * 2/2002 Gyllenhammar ..... 52/69
6,594,960 B2 7/2003 Brittain et al.
6,821,071 B2 11/2004 Woolslayer et al.
6,910,679 B1 6/2005 Vogt et al.
2003/0051915 A1 * 3/2003 Brittain et al. ..... 175/52
2011/0120043 A1 * 5/2011 Vogt ..... 52/646

* cited by examiner

*Primary Examiner* — Branon Painter
(74) *Attorney, Agent, or Firm* — Head Johnson & Kachigian P.C.

(57) ABSTRACT

A hingeable derrick, comprising an upper structure with a first face and a second face opposite the first face; a lower structure with a first face and a second face opposite the first face; a hinge connecting the second face of the upper structure to the second face of the lower structure; and at least one hydraulic cylinder, where each hydraulic cylinder has an upper end attached to the upper structure. The upper structure is located directly above the lower structure in an upright position when the hydraulic cylinder is retracted, and the upper structure may pivot at the hinge in the direction of the second face into a folded position, with the descent controlled by winch lines.

11 Claims, 2 Drawing Sheets

HINGEABLE DERRICK

BACKGROUND OF THE INVENTION

1. Field of the Invention

This invention relates generally to a hingeable derrick, and more particularly to derrick for use on an offshore drilling rig where the derrick may be easily folded to allow passage of the rig under a bridge or to increase stability during severe weather and may be easily returned to an upright position for use.

2. Description of the Related Art

Offshore drilling structures typically comprise a four sided derrick structure. Derricks are usually designed for one time assembly on offshore drilling rigs, such as jack ups, semi submersible, and drill ships. In some instances, three sided cantilever type masts have been used in place of four-sided derricks when transportation restrictions required that the structure be lowered. The lowering was done to provide necessary height clearance and/or increased stability during tow in severe weather. However, in most cases, four sided derricks are preferred over three sided masts because they provide the most efficient design. For example, they provide more capacity and stiffness with less weight.

Based on the foregoing, it would be desirable to provide a four sided derrick that can be folded and thus provide reduced height for clearance and stability and may be easily returned to an upright position for use.

SUMMARY OF THE INVENTION

In general, in a first aspect, the present invention relates to a hingeable derrick, comprising: an upper structure with a first face, a second face opposite the first face, and a third face and a fourth face each connecting the first face to the second face; a lower structure with a first face, a second face opposite the first face, and a third face and a fourth face each connecting the first face to the second face; a hinge connecting the second face of the upper structure to the second face of the lower structure; and at least one hydraulic cylinder, where each hydraulic cylinder has an upper end and a lower end and where the upper end is attached to the upper structure. The upper structure is located directly above the lower structure in an upright position when the hydraulic cylinder is retracted. The upper structure may pivot at the hinge in the direction of the second face into a folded position.

The at least one hydraulic cylinder may comprise a first hydraulic cylinder and a second hydraulic cylinder, where the upper end of the first hydraulic cylinder is attached to the third face of the upper structure and the upper end of the second hydraulic cylinder is attached to the fourth face of the upper structure. The lower end of the hydraulic cylinder may be removably or non-removably attached to the lower structure or to a drill floor upon which the hingeable derrick is positioned. The upper end of each of the hydraulic cylinders may be removably or non-removably attached to the upper structure.

The first face of the lower structure may be shorter than the second face of the lower structure such that the third face and the fourth face of the lower structure each have a top that angles downward at an angle from the second face to the first face. The first face of the upper structure may be correspondingly longer than the second face of the upper structure such that the third face and the fourth face of the upper structure each have a bottom that angles downward at an angle from the second face to the first face, where the angle of the bottoms of the third face and the fourth face of the upper structure is the same as the angle of the tops of the third face and the fourth face of the lower structure:

The hingeable derrick may further comprise at least one winch-controlled line attached to the upper structure. The at least one winch-controlled line may comprise a first winch-controlled line and a second winch-controlled line, where the first winch-controlled line is attached to the third face of the upper structure and the second winch-controlled line is attached to the fourth face of the upper structure. The hingeable derrick may further comprise a support structure located such that the upper structure may rest on the support structure when the upper structure is in the folded position. The hingeable derrick may further comprise an attachment device removably attaching the first face of the upper structure to the first face of the lower structure.

The hingeable derrick may be part of an offshore drilling rig. The lower structure may be of sufficiently low height that the hingeable derrick may be transported under a bridge when the upper structure is in the folded position. The hingeable derrick may be located on a drill floor and the lower structure may be of sufficient height that the upper structure is located above any other structures on the drill floor when the upper structure is in the folded position.

The hingeable derrick may be folded by extending the at least one hydraulic cylinder and allowing the upper structure to pivot at the hinge in the direction of the second face into a folded position. If the upper end of each hydraulic cylinder is removably attached to the upper structure, the method may further comprise detaching the at least one hydraulic cylinder when the upper structure reaches a break over point and allowing gravity to continue pivoting the upper structure. If the hingeable derrick further comprises at least one winch-controlled line attached to the upper structure, the method may further comprise using the winch-controlled lines to control how quickly the upper structure pivots after it has reached the break over point.

The hingeable derrick may be unfolded by winching the winch-controlled lines such that the upper structure pivots upward at the hinge toward an upright position, attaching the at least one hydraulic cylinder to the upper structure when the upper structure reaches a break over point, and retracting the hydraulic cylinders such that the upper structure continues to pivot upward at the hinge into an upright position where the upper structure is located directly over the lower structure. The method may further comprise attaching the first face of the upper structure to the first face of the lower structure via a removable attachment device.

Other advantages and features will be apparent from the following description and from the claims.

DETAILED DESCRIPTION OF THE PREFERRED EMBODIMENTS

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
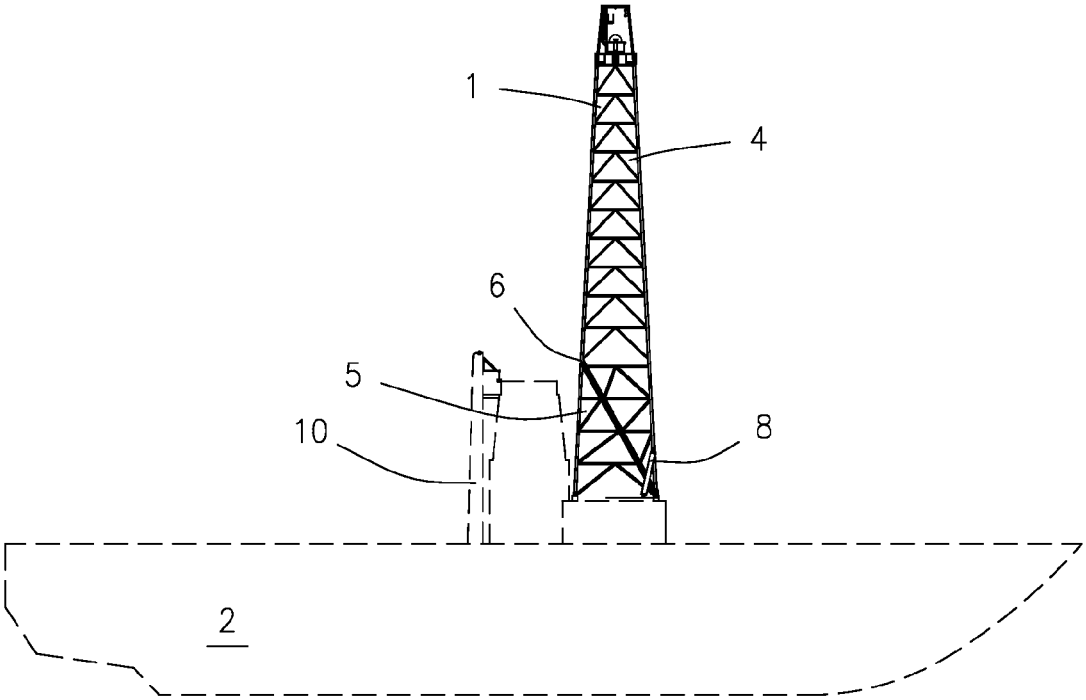
FIG. 1 is a side view of a hingeable derrick on an offshore drilling rig where the hingeable derrick is in an upright position.
Figure 2:
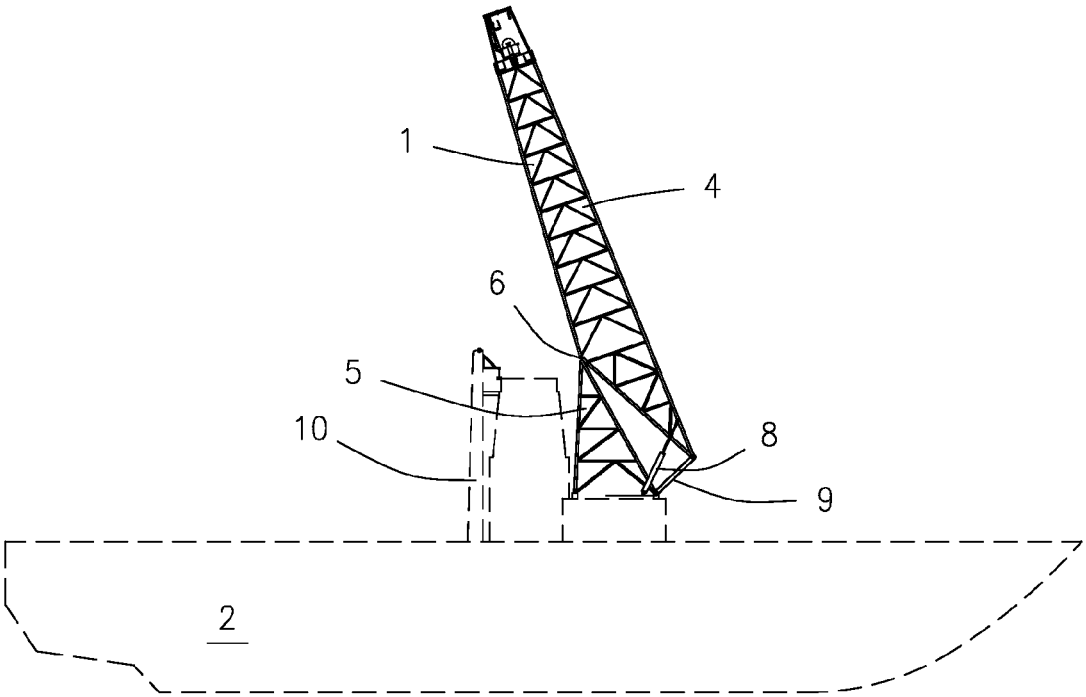
FIG. 2 is a side view of a hingeable derrick on an offshore drilling rig where the hingeable derrick is in a partially folded position.
Figure 3:
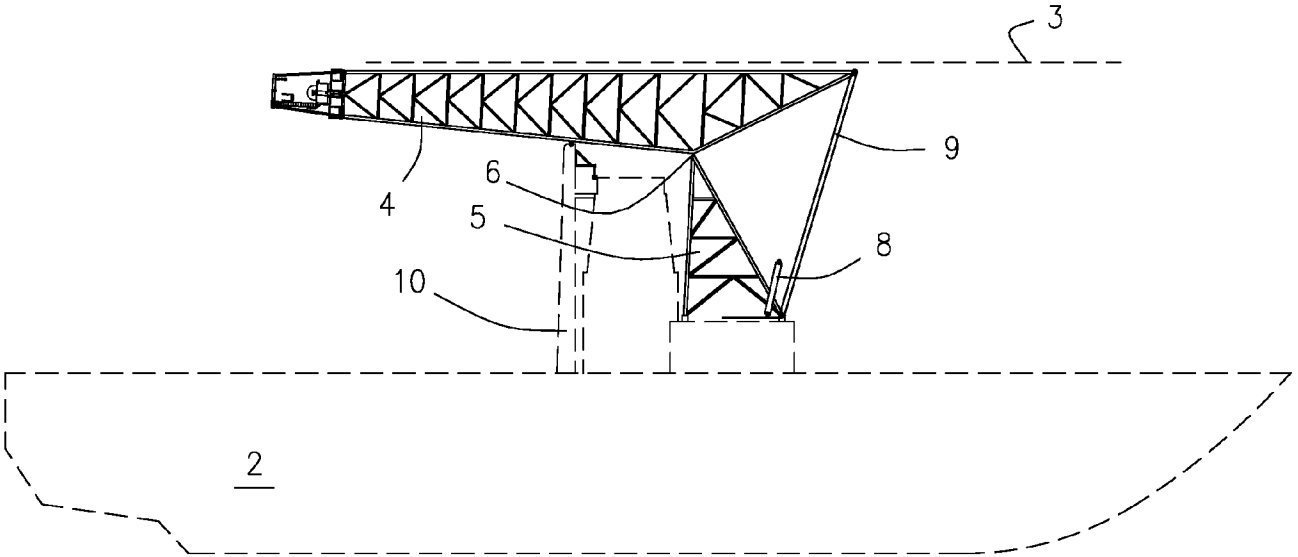
FIG. 3 is a side view of a hingeable derrick on an offshore drilling rig where the hingeable derrick is in a fully folded position.

Referring to the figures of the drawings, wherein like numerals of reference designate like elements throughout the several views, FIG. 1 shows a four sided hingeable derrick 1 in an upright position. The hingeable derrick 1 may be part of an offshore drilling rig, such as a drill ship 2, shown in dashed lines, or an offshore platform (not shown). As shown in FIGS. 2 and 3, the hingeable derrick 1 may be folded to allow the drill ship 2 to travel under a bridge with a low clearance 3 or to provide increased stability during severe weather.

As seen in FIGS. 1, 2, and 3, the hingeable derrick 1 has an upper structure 4 and a lower structure 5. A hinge 6 is located on the aft face of the hingeable derrick 1 and connects the upper structure 4 to the lower structure 5. Alternately, the hinge 6 may be located on the forward face of the hingeable derrick 1, or on either of the side faces of the hingeable derrick 1. The hinge 6 may be located high enough on the hingeable derrick 1 that the upper structure 4 will clear the drill floor when the hingeable derrick 1 is in a folded position.

Figure 4:
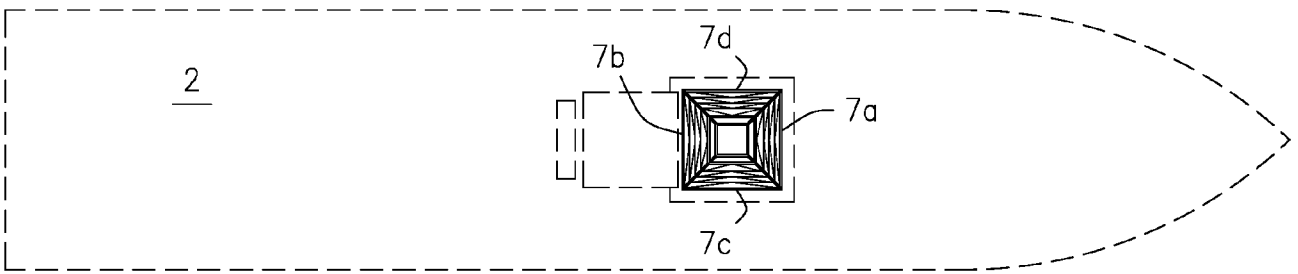
FIG. 4 is an overhead view of a hingeable derrick on an offshore drilling rig where the hingeable derrick is in an upright position.

As seen in FIG. 4, the hingeable derrick 1 has four sides: a first face 7*a*, a second face 7*b* opposite the first face 7*a*, a third face 7*c*, and a fourth face 7*d*, where the third face 7*c* is opposite the fourth face 7*d* and the third face 7*c* and the fourth face 7*d* each connect the first face 7*a* to the second face 7*b*. If the hinge 6 is located on the aft face of the hingeable derrick 1, the forward face is the first face 7*a*, the aft face is the second face 7*b*, and the two side faces are the third face 7*c* and the fourth face 7*d*. If the hinge 6 is located on the forward face of the hingeable derrick 1, the aft face is the first face 7*a*, the forward face is the second face 7*b*, and the two side faces are the third face 7*c* and the fourth face 7*d*. If the hinge 6 is located on either of the side faces of the hingeable derrick 1, that side face is the second face 7*b*, the other side face is the first face 7*a*, and the forward and aft faces are the third face 7*c* and the fourth face 7*d*.

The lower structure 5 may be shorter on its first face 7*a* than on its second face 7*b*, with the third and fourth faces 7*c* and 7*d* of the lower structure 5 having tops that angle downward from the second face 7*b* to the first face 7*a*. The upper structure 4 may be correspondingly longer on its first face 7*a* than on its second face 7*b*, with the third and fourth faces 7*c* and 7*d* of the upper structure 4 having bottoms that angle downward from the second face 7*b* to the first face 7*a*. Thus, when assembled, the upper structure 4 and the lower structure 5 form a complete four sided derrick with the bottom of the upper structure 4 meeting the top of the lower structure 5.

Hydraulic cylinders 8 may be located near both the third and fourth faces 7*c* and 7*d* of the hingeable derrick 1. One hydraulic cylinder 8 may have a first end attached to the third face 7*c* of the upper structure 4 and a second end attached to either the third face 7*c* of the lower structure 5 or the drill floor. A second hydraulic cylinder 8 may have a first end attached to the fourth face 7*d* of the upper structure 4 and a second end attached to either the fourth face 7*d* of the lower structure 5 or the drill floor. The hydraulic cylinders 8 may be removably attached on either their first ends or second ends, or both, to allow the hydraulic cylinders 8 to be at least partially disconnected or removed from the hingeable derrick 1. The hydraulic cylinders 8 may be only partially disconnected for transport, but completely removed for drilling operations. When the hydraulic cylinders 8 are fully retracted, the hingeable derrick 1 is in an upright position with the upper structure 4 located directly over the lower structure 5. When the hydraulic cylinders 8 are extended, the first face 7*a* of the upper structure 4 is lifted and the upper structure 4 pivots on the hinge 6 and tilts in the direction of the second face 7*b*.

As the upper structure 4 is moved, its center of gravity is initially located such that gravity acts to attempt to return the upper structure 4 to an upright position. The hydraulic cylinders 8 act against this gravitational force to lift the first face 7*a* of the upper structure and cause the upper structure 4 to pivot on the hinge 6. As the hydraulic cylinders 8 lift the first face 7*a* of the upper structure 4 and the top of the upper structure 4 angles in the direction of the second face 7*b*, the center of gravity of the upper structure 4 shifts past a gravitational break over point such that gravity thereafter acts to attempt to further lower the top of the upper structure 4. The gravitational break over point is the point where the center of gravity of the upper structure 4 is located directly over hinge 6. The hydraulic cylinders 8 may be designed to be long enough to be fully extended when the upper structure 4 reaches this break over point or beyond this break over point. At the break over point, the upper structure 4 wants to continue hinging and go into free fall, but this descent is limited by the maximum stroke of the cylinders 8. At the break over point, the cylinders 8 go into tension and counter balance the derrick for a short distance. The hydraulic cylinders 8 may thereafter be detached either from the upper structure 4 or from either the lower structure 3 or the drill floor, with gravity acting to continue lowering the upper structure 4 into a folded position. The hydraulic cylinders 8 may travel beyond the break over point for some distance. Before detaching the hydraulic cylinders 8, one or more winch-controlled lines 9 may be attached to the first face 7*a* of the upper structure 4 to control the descent of the upper structure 4 after detachment of the hydraulic cylinders 8. Before reaching the break over point, the winch lines 9 are slack. At the break over point, the slack of the winch lines 9 are taken up and relieves the cylinders 8 of the tension loading. Once the winch lines 9 have the full load, the cylinders 8 can be retracted and the winch lines 9 lower the derrick to the folded position. As a safety feature, both the cylinders 8 and the winch lines 9 are attached both at the break over point and beyond the break over point for a short distance in either direction.

When in the folded position, the upper structure 4 may be nearly perpendicular to the lower structure 5. The upper structure 4 may be supported in the folded position by a support structure 10, upon which the upper structure 4 may rest after being lowered.

To raise the upper structure 4 into an upright position, the winch-controlled line 9 is retracted to raise the upper structure 4 nearly to the gravitational break over point. The hydraulic cylinders 8 are reattached either to the upper structure 4 or to either the lower structure 3 or the drill floor, and the winch lines 9 pull the upper structure 4 past the break over point. The hydraulic cylinders 8 are retracted to control the movement of the upper structure 4 as it returns to the upright position. During the return after the break over point, the hydraulic cylinders 8 take the load in compression and the winch lines 9 are slack.

When in an upright position, the upper structure 4 may be secured to the lower structure 5 via one or more securing devices to prevent accidental folding of the derrick. For example, shoe pins located on the first side 7*a* of the hingeable derrick 1 may be used to secure the upper structure 4 to the lower structure 5.

The hingeable derrick 1 incorporates the advantages of a four-sided derrick with the ability to attain a reduced height. Also, the elevated pivot point ensures that only a portion of the derrick is actually lowered. This allows for increased efficiency of the cylinders and minimized erection loads.

Whereas, the devices and methods have been described in relation to the drawings and claims, it should be understood that other and further modifications, apart from those shown or suggested herein, may be made within the spirit and scope of this invention.

What is claimed is:

1. A hingeable derrick, comprising:

an upper structure with a first face, a second face opposite the first face, and a third face and a fourth face each connecting the first face to the second face;

a lower structure with a first face, a second face opposite the first face, and a third face and a fourth face each connecting the first face to the second face;

a hinge connecting the second face of the upper structure to the second face of the lower structure; and at least one hydraulic cylinder, where each hydraulic cylinder has an upper end and a lower end and where the upper end is directly attached to the upper structure and where the upper end is removably attached to the upper structure;

where the upper structure is located directly above the lower structure in an upright position when the hydraulic cylinder is retracted and where the upper structure may pivot at the hinge in the direction of the second face into a folded position.

2. The hingeable derrick of claim 1 where the at least one hydraulic cylinder comprises a first hydraulic cylinder and a second hydraulic cylinder, where the upper end of the first hydraulic cylinder is attached to the third face of the upper structure and the upper end of the second hydraulic cylinder is attached to the fourth face of the upper structure.

3. The hingeable derrick of claim 1 where:

the first face of the lower structure is shorter than the second face of the lower structure such that the third face and the fourth face of the lower structure each have a top that angles downward at an angle from the second face to the first face; and the first face of the upper structure is correspondingly longer than the second face of the upper structure such that the third face and the fourth face of the upper structure each have a bottom that angles downward at an angle from the second face to the first face, where the angle of the bottoms of the third face and the fourth face of the upper structure is the same as the angle of the tops of the third face and the fourth face of the lower structure.

4. The hingeable derrick of claim 1 further comprising at least one winch-controlled line attached to the upper structure.

5. The hingeable derrick of claim 4 where the at least one winch-controlled line comprises a first winch-controlled line and a second winch-controlled line, where the first winch-controlled line is attached to the third face of the upper structure and the second winch-controlled line is attached to the fourth face of the upper structure.

6. The hingeable derrick of claim 1 further comprising a support structure located such that the upper structure may rest on the support structure when the upper structure is in the folded position.

7. The hingeable derrick of claim 1 further comprising an attachment device removably attaching the first face of the upper structure to the first face of the lower structure.

8. A method of folding a hingeable derrick comprising an upper structure with a first face, a second face opposite the first face, and a third and a fourth face each connecting the first face to the second face; a lower structure with a first face, a second face opposite the first face, and a third and a fourth face each connecting the first face to the second face; a hinge connecting the second face of the upper structure to the second face of the lower structure; and at least one hydraulic cylinder, where each hydraulic cylinder has an upper end and a lower end and where the upper end is attached to the upper structure and where the upper end of the hydraulic cylinder is removably attached to the upper structure; where the upper structure is located directly above the lower structure in an upright position when the hydraulic cylinder is retracted and where the upper structure may pivot at the hinge in the direction of the second face into a folded position, where the method comprises:

extending the at least one hydraulic cylinder;

allowing the upper structure to pivot at the hinge in the direction of the second face into a folded position; and detaching the at least one hydraulic cylinder when the upper structure reaches a break over point and allowing gravity to continue pivoting the upper structure.

9. The method of claim 8 where the hingeable derrick further comprises at least one winch-controlled line attached to the upper structure, where the method further comprises using the winch-controlled line to control how quickly the upper structure pivots after it has reached the break over point.

10. A method of unfolding a hingeable derrick comprising an upper structure with a first face, a second face opposite the first face, and a third and a fourth face each connecting the first face to the second face; a lower structure with a first face, a second face opposite the first face, and a third and a fourth face each connecting the first face to the second face; a hinge connecting the second face of the upper structure to the second face of the lower structure; at least one winch-controlled line attached to the upper structure; and at least one hydraulic cylinder, where each hydraulic cylinder has an upper end and a lower end and where the upper end may be removably attached to the upper structure; where the upper structure is initially substantially perpendicular to the lower structure, where the method comprises:

winching the at least one winch-controlled line such that the upper structure pivots upward at the hinge toward an upright position;

attaching the at least one hydraulic cylinder to the upper structure when the upper structure reaches a break over point; and retracting the hydraulic cylinders such that the upper structure continues to pivot upward at the hinge into an upright position where the upper structure is located directly over the lower structure.

11. The method of claim 10 further comprising attaching the first face of the upper structure to the first face of the lower structure via a removable attachment device.

* * * * *